US008819956B2

(12) United States Patent
Kim et al.

(10) Patent No.: US 8,819,956 B2
(45) Date of Patent: Sep. 2, 2014

(54) CLOTHES DRYER

(75) Inventors: Sungmin Kim, Seoul (KR); Jongseok Kim, Seoul (KR); Daeyun Park, Seoul (KR); Sogkie Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 320 days.

(21) Appl. No.: 12/917,993

(22) Filed: Nov. 2, 2010

(65) Prior Publication Data

US 2011/0099835 A1 May 5, 2011

(30) Foreign Application Priority Data

Nov. 3, 2009 (KR) ..... 10-2009-0105588

(51) Int. Cl.

| | |
|---|---|
| ***F26B 11/02*** | (2006.01) |
| ***D06F 58/10*** | (2006.01) |
| ***D06F 39/12*** | (2006.01) |
| ***D06F 58/20*** | (2006.01) |

(52) U.S. Cl.

CPC ..... *D06F 39/125* (2013.01); *D06F 58/10* (2013.01); *D06F 58/20* (2013.01)

USPC ..... 34/132; 34/209; 34/210; 34/211

(58) Field of Classification Search

USPC ..... 34/132, 209–211

See application file for complete search history.

(56) References Cited

U.S. PATENT DOCUMENTS

| | | | | |
|---|---|---|---|---|
| 2,904,081 | A * | 9/1959 | Wolf et al. | 141/290 |
| 3,402,477 | A * | 9/1968 | Hubbard | 34/543 |
| 4,819,341 | A * | 4/1989 | Gayso | 34/86 |
| 8,245,414 | B2 * | 8/2012 | Watson et al. | 34/381 |
| 8,307,567 | B2 * | 11/2012 | Han et al. | 34/73 |

FOREIGN PATENT DOCUMENTS

JP 04-187194 7/1992

OTHER PUBLICATIONS

International Search Report dated Dec. 7, 2011.

* cited by examiner

*Primary Examiner* — Kenneth Rinehart
*Assistant Examiner* — Gajanan M Prabhu
(74) *Attorney, Agent, or Firm* — Ked & Associates, LLP

(57) ABSTRACT

An apparatus for drying clothes includes a body having an inner space, a first dryer rotatably arranged in the inner space to dry a first load of laundry while the first load is tumbled, and a second dryer to dry a second load of laundry without tumbling. The second dryer uses air discharged from the first dryer to dry the second load of laundry.

11 Claims, 5 Drawing Sheets

CLOTHES DRYER

CROSS-REFERENCE TO RELATED APPLICATION

This application claims priority under 35 USC §119 to Korean Patent Application No. 10-2009-0105588 filed on Nov. 3, 2009, the contents of which is incorporated herein by reference.

BACKGROUND

1. Field

One or more embodiments described herein relate to an appliance.

2. Background

Dryers tumble all types of clothes in the same manner. As a result, more delicate clothing may be torn or otherwise damaged during a drying cycle. Also, dryers that have doors along a front panel have proven to be inconvenient, because users must bend over in order to insert and retrieve the laundry.

DETAILED DESCRIPTION

Figure 1:
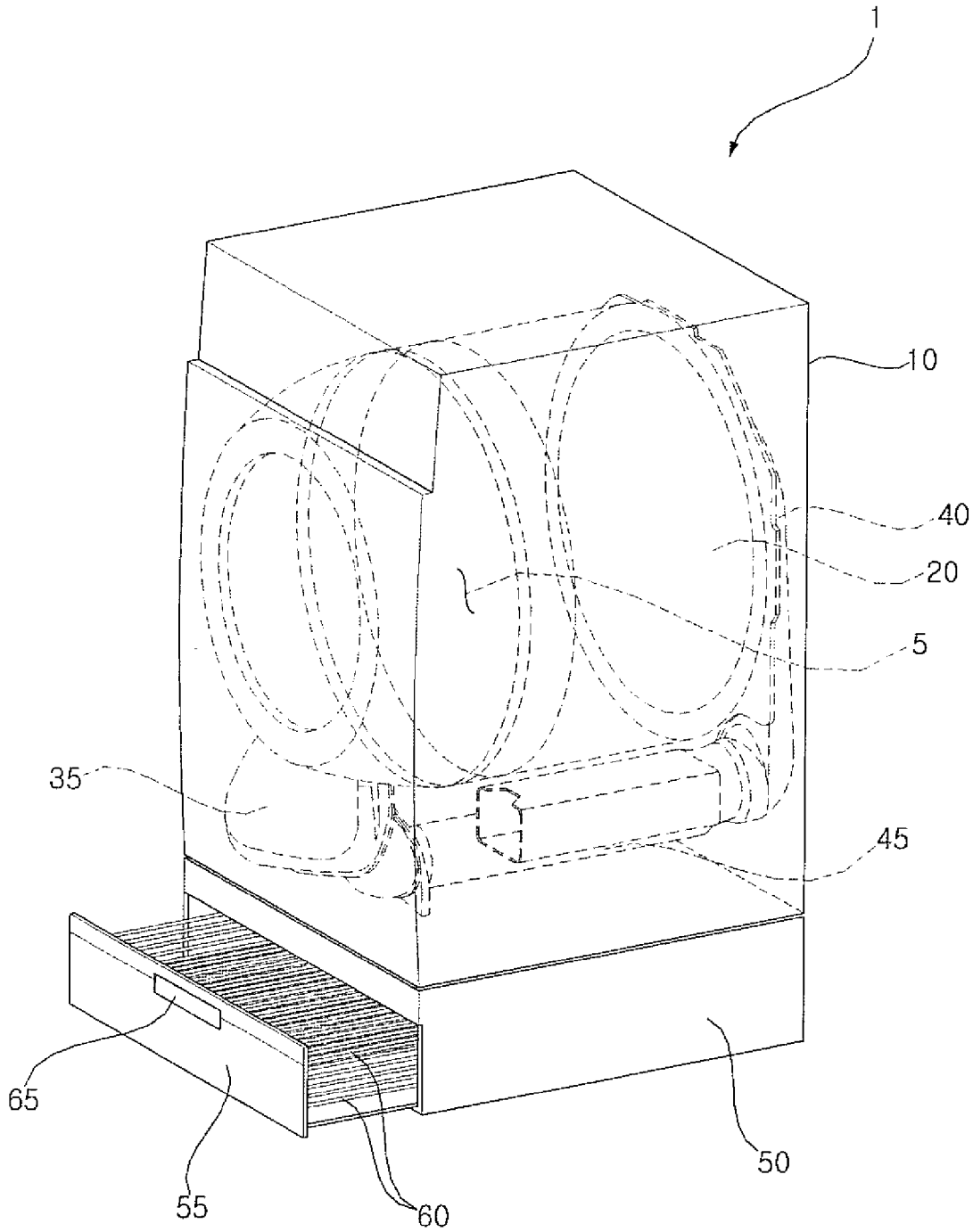
FIG. 1 is a diagram of one embodiment of a clothes dryer.
Figure 2:
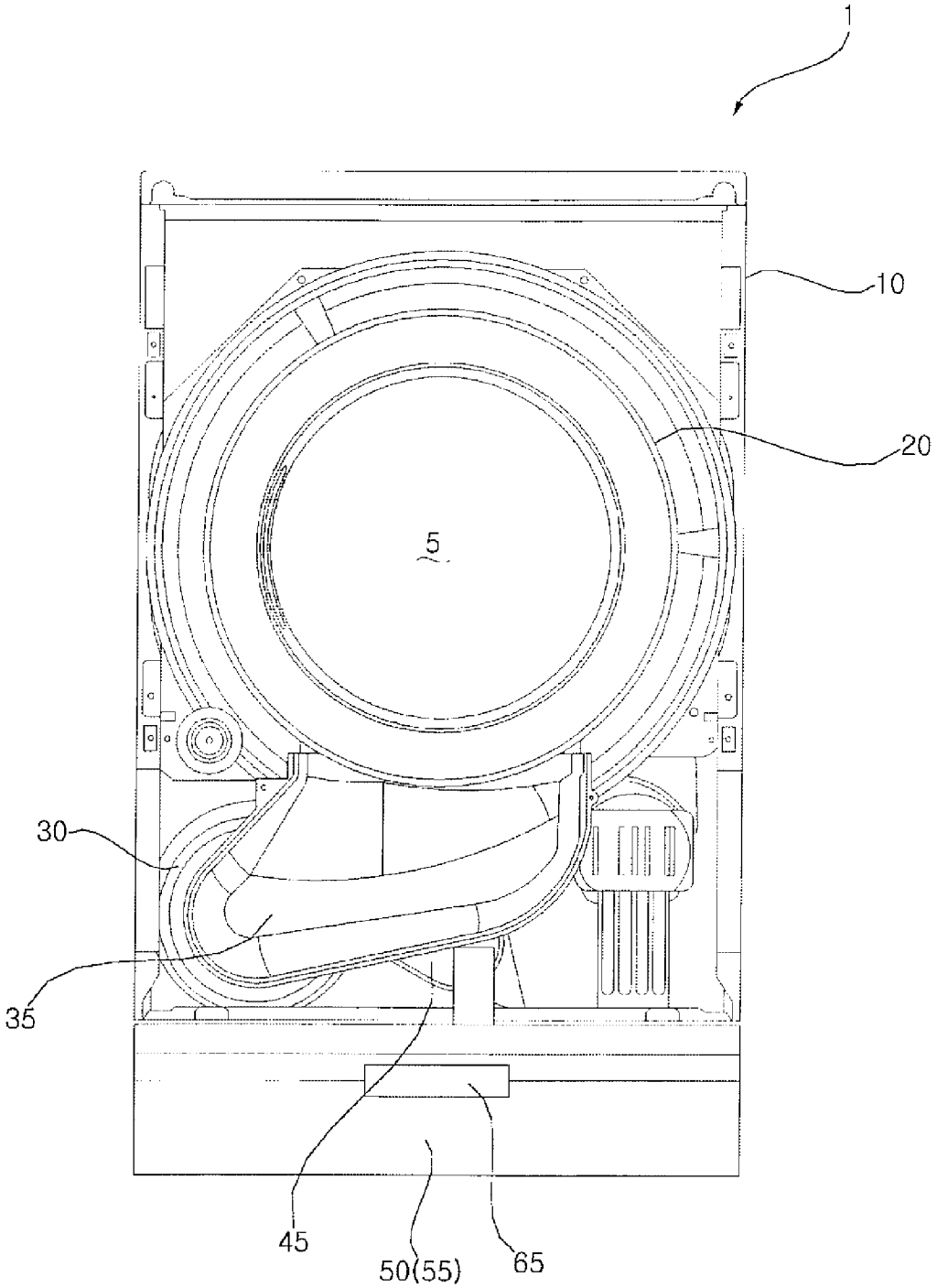
FIG. 2 is a diagram of a front view of the dryer.

Referring to FIGS. 1 and 2, one embodiment of a clothes dryer 1 includes a main body 10 and a main drying unit 20. The main body 10 has a predetermined inner space 5, and the main drying unit 20 is rotatably arranged in the inner space 5. In this embodiment, the main drying unit is rotatably installed in the inner space with respect to a front-to-rear horizontal axis by a power transmission unit (not shown) arranged at a rear side of the inner space.

Wet laundry that needs to be tumbled is put into the main drying unit 20, and the main drying unit 20 tumbles the laundry. Tumbling is preferred in order to untangle the wet laundry; that is, when dried without tumbling, wet laundry easily becomes tangled. The tangled laundry is not untangled by the main drying unit 20 alone, thereby increasing drying time. In addition, when dried without tumbling, the laundry may be left wrinkled even after the drying process is finished. Thus, tumbling is preferred in order to prevent this from happening.

The main drying unit 20 is oriented relative to the front-to-rear horizontal axis and is open at its front and rear sides. A user may put wet laundry into and pull dried laundry from the main drying unit 20 through the front opening. The rear opening is shielded by a shielding panel (not shown).

A heated air introduction path 40 is arranged at a rear side of the shielding panel, so that heated air generated from an air heating unit 30 may be introduced into the main drying unit 20. The heated air introduction path 40 may be shaped as a tube and may have an entrance part that abuts or is otherwise adjacent to the shielding panel. The entrance part may have the same size as that of the shielding panel.

A plurality of pores may be uniformly arranged in the shielding panel to allow heated air to be introduced from the heated air introduction path 40 into the main drying unit 20.

The air heating unit 30 is arranged at a lower side of the inner space 5, which corresponds to a lower portion of the main drying unit 20, to generate and supply heated air to the heated air introduction path 40. The air heating unit 30 is a heater that draws external air into the inner space 5 and heats the air to a predetermined temperature.

The heated air is introduced into the main drying unit 20 and exchanges heat with the wet laundry that is tumbled in the main drying unit 20. During this process, the wet laundry is dried and the heated air is converted into damp air. According to one embodiment, the damp air may be reheated by the air heating unit 30 while it is discharged to the outside through a heated air discharge path 45.

The air heating unit 30 may be arranged at a front and lower side of the inner space 5. According to such arrangement, a user may be prevented from being directly influenced by noise created during operation of the air heating unit 30, thus insuring a pleasant environment.

The heated air introduction path 40 may be arranged to connect the air heating unit 30 arranged at a front side with the shielding panel arranged at a rear side of the main drying unit 20.

The heated air is discharged from the main drying unit 20 through the heated air discharge path 45 to the outside. More specifically, the heated air used for drying the wet laundry in the main drying unit 20 is discharged to the outside through the heated air discharge path 45, that is connected between a front side of the main drying unit 20 and a rear side of the main body 10 and that communicates with the outside. According to one embodiment, the heated air discharge path 45 may be connected to the air heating unit 30. Like the heated air introduction path 40, the heated air discharge path 45 may be substantially shaped as a tube.

A blowing unit 35 is arranged over the heated air discharge path 45 to provide a force for introducing heated air into the main drying unit 20 or a force for discharging heated air from the main drying unit 20 to the outside. The blowing unit 35 is configured to generate a flow force from a rotational force of a blowing fan.

In operation, when a user puts wet laundry in the main drying unit 20 through the front opening and manipulates a control panel (not shown) arranged, for example, on a front upper side of the main body 10, the main drying unit 20 is rotated to tumble the wet laundry in the main drying unit 20.

Simultaneously, the air heating unit 30 generates heated air and supplies the heated air into the main drying unit 20 through the heated air introduction path 40 to dry the tumbled laundry. Then, the heated air is discharged to the outside through the heated air discharge path 45. According to an embodiment, the used heated air may be reheated by the air heating unit 30 and introduced into the main drying unit 20 through the heated air introduction path 40.

Generally, the air circulation path of a clothes dryer involves introducing external air into the inner space 5, heating the external air by the air heating unit 30, drying wet laundry with the heated air, and discharging the used heated air to the outside.

However, as the height of dryers increase, users increasingly need to bend over to load and unload clothes from the dyer, which causes inconvenience to the user. To eliminate this inconvenience, one approach involves arranging the front opening of the main drying unit 20 at an upper side of the inner space. However, this arrangement may be considered disadvantageous because it requires the main drying unit to be arranged at an upper side of the inner space in order to allow the main drying unit to remain horizontal.

Accordingly, a height adjusting unit may be provided at a lower side of the main body, which may freely extend or contract so that the front opening may be positioned at a height desired by a user.

According to one embodiment, clothes dryer 1 may include an auxiliary drying unit detachably arranged at a lower portion of the main body 10, so as to eliminate user inconvenience and at the same time separately dry laundry considered inappropriate for tumbling, which, for example, may include more delicate clothing that can easily be torn with slight friction or otherwise damaged during tumbling.

Since the auxiliary drying unit is detachably provided at the lower portion of main body 10, the user may combine the auxiliary drying unit with the main body 10 when the auxiliary drying unit is needed. Accordingly, user convenience may be enhanced. If the auxiliary drying unit is not needed, then the auxiliary drying unit may not be used.

According to one embodiment, the auxiliary drying unit is detachably provided at a lower portion of the main body 10. In this manner, the auxiliary drying unit both raises the height of the main body 10 (to a position which, for example, is more convenient to the user during loading and unloading because little or no bending is required) and dries clothes considered inappropriate or unsuitable for tumbling. That is, clothes received in the auxiliary drying unit may be dried without tumbling.

As shown, the auxiliary drying unit includes an auxiliary drying unit main body 50 arranged at a lower portion of the main body 10, a receiving part 55 combined with the auxiliary drying unit main body 50 and slidably moved to a front side of the auxiliary drying unit main body 50, and a docking unit provided in the auxiliary drying unit main body 50 to allow the auxiliary drying unit main body 50 to communicate with the heated air discharge path 45 arranged in the main body 10 when the auxiliary drying unit is combined with the main body 10.

The receiving part 55 may be made in a similar manner to a drawer, and may include a grilled part 60 on which laundry may be hung or otherwise suspended. For example, the grilled part 60 may space wet laundry apart from the bottom surface by a predetermined height, so that heated air introduced through the docking unit may be evenly transferred to the overall laundry.

According to one design, the grilled part 60 may have at least two stages, including an upper stage and a lower stage, in the receiving part 55. The grilled part may have different designs in other embodiments For example, the grilled part 60 may be configured in one stage when tall laundry (e.g., shoes) is received in the receiving part 55.

A handle 65 may be arranged on a front surface of the receiving part 55 so that the user may slidingly move the receiving part 55 to load and unload laundry therefrom. As previously described, the docking unit may protrude upwardly from a top surface of the auxiliary drying unit main body 50 to be docked with the heated air discharge path 45 so that heated air may be introduced into the auxiliary drying unit main body 50. More specifically, the docking unit may extend from the top surface of the auxiliary drying unit main body 50.

Additionally, the docking unit may include an inlet part 70*a* and outlet part 70*b* that are spaced apart from each other by a predetermined distance. The inlet part 70*a* is relatively arranged at a front side of the top surface of the auxiliary drying unit main body 50 and docked with a front portion of the heated air discharge path 45 to introduce heated air from the heated air discharge path 45 into the auxiliary drying unit main body 50.

The outlet part 70*b* is relatively arranged at a rear side of the top surface of the auxiliary drying unit main body 50 and docked with a rear portion of the heated air discharge path 45 to discharge heated air used for drying laundry from the auxiliary drying unit main body 50 to the heated air discharge path 45.

Figure 3:
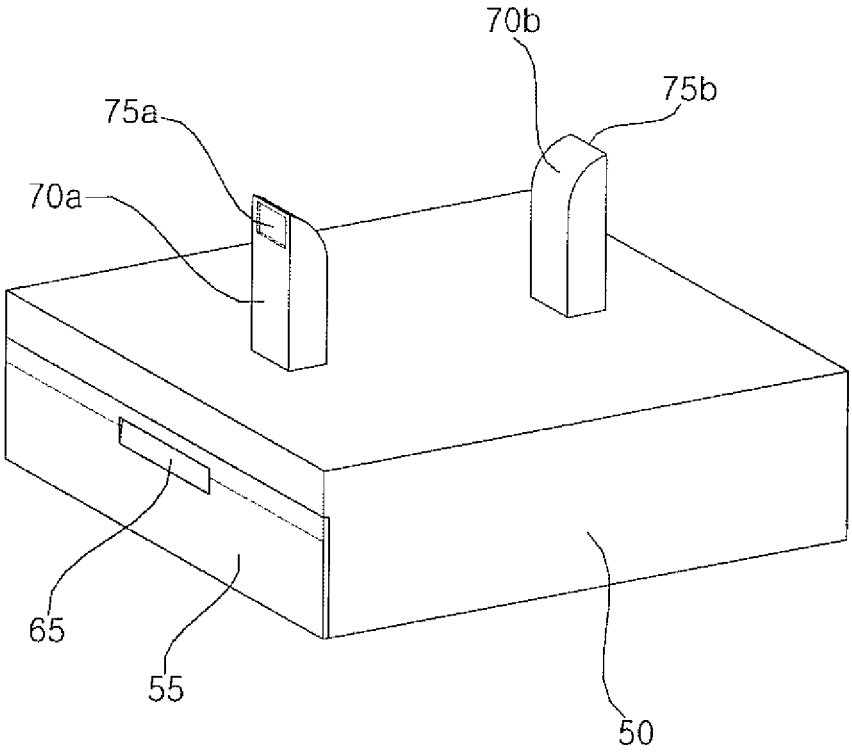
FIG. 3 is a diagram of an auxiliary drying unit in the dryer.
Figure 4:
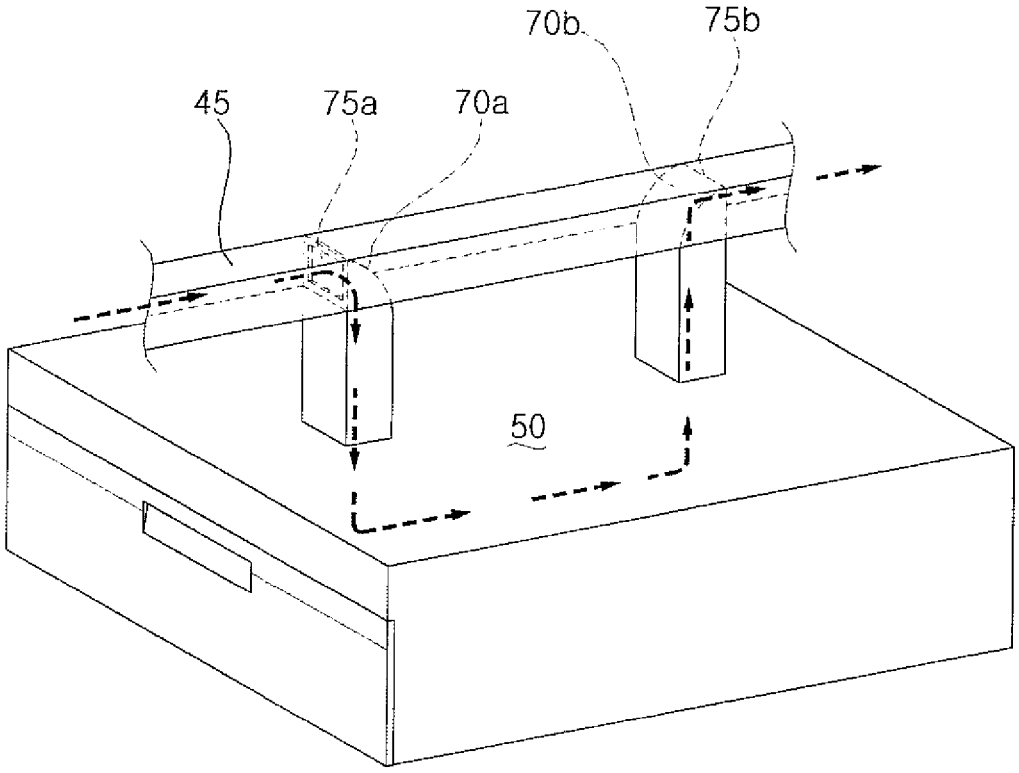
FIG. 4 is a diagram of one mode of operation of the auxiliary drying unit.
Figure 5:
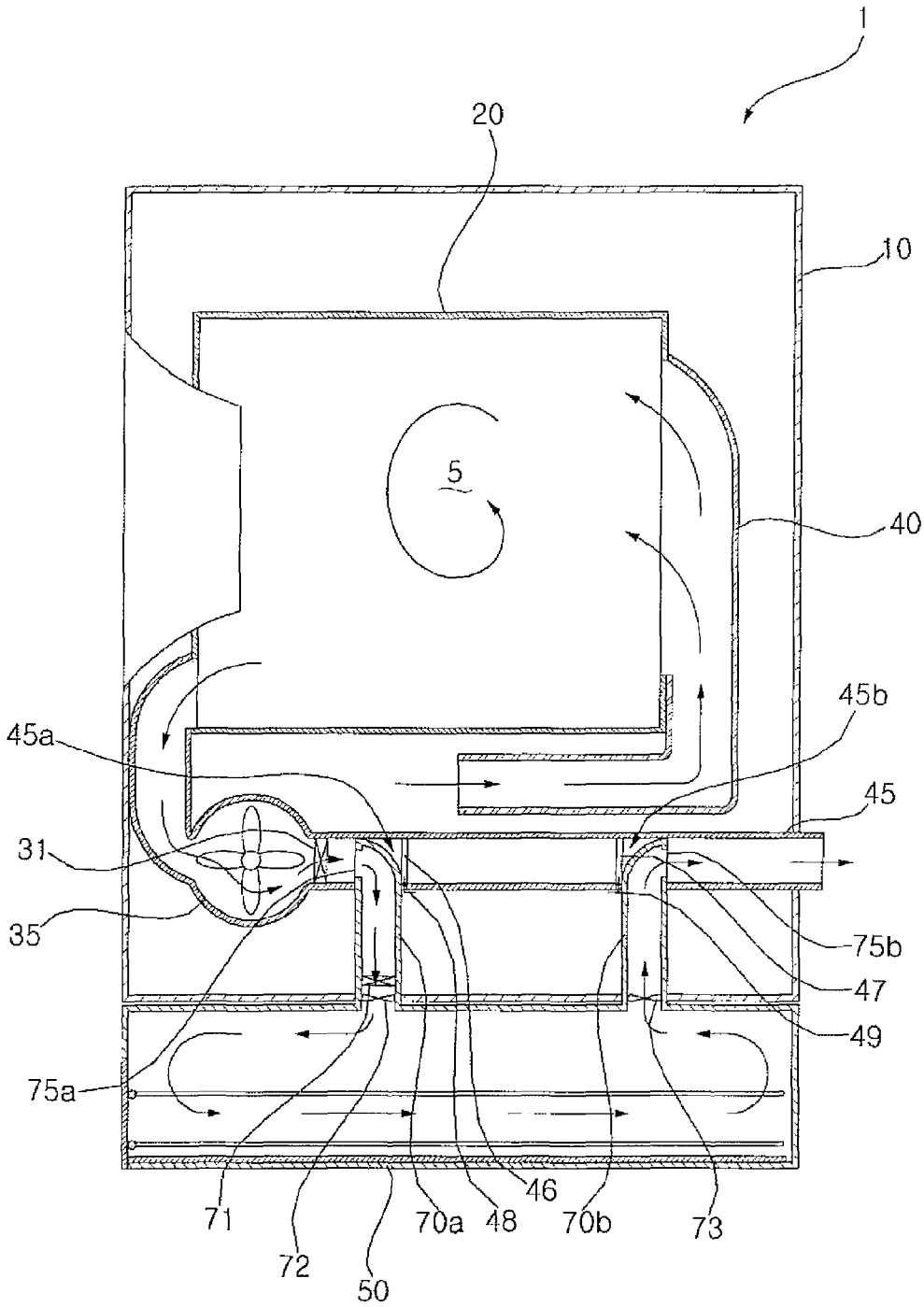
FIG. 5 is a drawing of one mode of operation of the dryer.

As shown in FIGS. 3-5, the inlet part 70*a* and the outlet part 70*b* include an inlet port 75*a* and an outlet port 75*b*, respectively, to communicate the heated air discharge path 45 with the auxiliary drying unit main body 50.

The inlet port 75*a* is provided in the inlet part 70*a* to guide heated air from the heated air discharge path 45 into the auxiliary drying unit main body 50 for drying clothes, and the outlet port 75*b* is provided in the outlet part 70*b* to guide the heated air used for drying laundry in the auxiliary drying unit main body 50 to the heated air discharge path 45 for discharge.

Further, the heated air discharge path 45 includes a first docking hole 45*a* and a second docking hole 45*b* to allow for connection with the inlet part 70*a* and the outlet part 70*b*, respectively. When the inlet part 70*a* and the outlet part 70*b* are not docked with the heated air discharge path 45, first and second shielding plates 46 and 47 may be arranged adjacent to the first and second docking holes 45*a* and 45*b*, respectively, to shield the first and second docking holes 45*a* and 45*b*.

The first and second shielding plates 46 and 47 may be arranged to rotate with respect to one or more hinges to shield the heated air discharge path 45 when pushed upwardly by an external force, e.g., while the inlet part 70*a* and outlet part 70*b* are docked with the heated air discharge path 45.

The first and second shielding plates 46 and 47 may be elastically supported by first and second elastic members 48 and 49, respectively, in a direction of closing the first and second docking holes 45*a* and 45*b* when the external force is removed.

More specifically, as shown in FIG. 5, while moving toward the first and second docking holes 45*a* and 45*b*, the inlet part 70*a* and the outlet part 70*b* upwardly push the first shielding plate 46 provided at the first docking hole 45*a* and the second shielding plate 47 provided at the second docking hole 45*b*. The pushed first and second shielding plates 46 and 47 serve to shield the heated air discharge path 45 between the first and second docking holes 45*a* and 45*b*. Upper portions of the inlet part 70*a* and the outlet part 70*b* may be formed to have a cross-section corresponding to a cross-section of the heated air discharge path 45.

The upper portions of the inlet part 70*a* and the outlet part 70*b* may be formed not to have a gap between the heated air discharge path 45 and each of the inlet part 70*a* and the outlet part 70*b* when docked with the heated air discharge path 45.

When the inlet part 70*a* and outlet part 70*b* are not docked with the heated air discharge path 45, e.g., when the auxiliary drying unit is not combined with the main body 10, heated air is introduced into the main drying unit 20 to dry laundry and then discharged to the outside through the heated air discharge path 45.

As shown in FIGS. 4 and 5, when the inlet part 70*a* and the outlet part 70*b* are docked with the heated air discharge path 45, the heated air is first introduced into the main drying unit 20 to dry the laundry and then introduced into the auxiliary drying unit main body 50 through the heated air discharge path 45 and the inlet part 70*a* to dry wet laundry in the auxiliary drying unit. Thereafter, the heated air is discharged from the auxiliary drying unit main body 50 through the outlet part 70*b* and the heated air discharge path 45 to the outside.

According to one embodiment, the inlet part 70*a* and the outlet part 70*b* may be formed of an extendable material or formed to have an extendable shape. In this case, when the auxiliary drying unit main body 50 is separated from the main body 10, the inlet part 70*a* and the outlet part 70*b* may be extended to remain docked with the heated air discharge path 45.

Further, when the auxiliary drying unit main body 50 is combined with the main body 10, the inlet part 70*a* and the outlet part 70*b* may be extended before being docked with the heated air discharge path 45, and then the auxiliary drying unit main body 50 and the main body 10 may be combined with each other.

Portions of the inlet part 70*a* and the outlet part 70*b* near the inlet port 75*a* and the outlet port 75*b* may be formed of a soft or bendable material. In this case, while the inlet part 70*a* and the outlet part 70*b* are docked with the heated air discharge path 45, the first and second shielding plates 46 and 47 pressurize the portions of the inlet part 70*a* and the outlet part 70*b* where the inlet port 75*a* and the outlet port 75*b* are formed to shield the first and second docking holes 45*a* and 45*b*. By shielding the first and second docking holes 45*a* and 45*b* by the first and second shielding plates 46 and 47, the heated air may be prevented from being introduced from the heated air discharge path 45 into the auxiliary drying unit main body 50.

According to one embodiment, a damper (not shown) may be provided in the heated air discharge path 45, to allow the heated air to be introduced from the heated air discharge path 45 to the auxiliary drying unit main body 50 or to be discharged from the heated air discharge path 45 to the outside. The damper may selectively open or close the inlet port 75*a* and/or outlet port 75*b* and the heated air discharge path 45.

A first auxiliary air heating unit 31 may be provided in the heated air discharge path 45 to reheat the heated air introduced from the heated air discharge path 45 into the auxiliary drying unit main body 50. The first auxiliary air heating unit 31 may be positioned between the blowing unit 35 and the first docking hole 45*a*, and/or between the main drying unit 20 and the blowing unit 35, to reheat the heated air introduced through the inlet port 75*a*.

According one embodiment, a second auxiliary air heating unit 71 may be provided in the inlet part 70*a*, to reheat the heated air introduced through the inlet part 70*a* into the auxiliary drying unit main body 50.

A first auxiliary blowing unit 72 may be provided in the inlet part 70*a*, to introduce the heated air from the heated air discharge path 45 through the inlet part 70*a* into the auxiliary drying unit main body 50.

Also, a second auxiliary blowing unit 73 may be provided in the outlet part 70*b*, to discharge the heated air from the auxiliary drying unit main body 50 through the outlet part 70*b* into the heated air discharge path 45.

Operation of one embodiment of clothes dryer 1 will now be explained with reference to the drawings, and particularly FIG. 5. First, a user puts wet laundry appropriate for tumbling through the front opening into the main drying unit 20, and slidingly withdraws the receiving part 55 of the auxiliary drying unit and hangs wet laundry inappropriate for tumbling on the grilled part 60.

Then, the user manipulates the control panel arranged on a front upper surface of the main body 10 to operate the clothes dryer 1. The main drying unit 20 receives a rotational force from the power transmission unit to start tumbling while air heated by the air heating unit 30 is simultaneously introduced into the main drying unit 20 through the heated air introduction path 40.

After drying the laundry tumbled in the main drying unit 20, the heated air flows through the heated air discharge path 45 by a discharge force of the blowing unit 35. The heated air flowing through the heated air discharge path 45 is reheated by the first auxiliary air heating unit 31 and introduced into the auxiliary drying unit main body 50 through the inlet part 70*a* by the first auxiliary blowing unit 72. According to one embodiment, the heated air introduced through the inlet part 70*a* may be reheated by the second auxiliary air heating unit 71.

The heated air introduced into the auxiliary drying unit main body 50 dries the wet laundry received in the receiving part 55. Then, the heated air is discharged by the second auxiliary blowing unit 73 from the auxiliary drying unit main body 50 through the outlet part 70*b* and the heated air discharge path 45 to the outside. According one embodiment, the heated air discharged to the heated air discharge path 45 may be reheated by the air heating unit 30 and then introduced into the main drying unit 20 through the heated air introduction path 40.

In accordance with one or more of the aforementioned embodiments, a clothes dryer is provided with an auxiliary drying unit, which both increases a height of the dryer for the user's convenience in loading and unloading clothes and selectively dries and thud preserves delicate clothes without tumbling.

According to an embodiment of the present invention, there is provided a clothes dryer including a main body including an inner space, a main drying unit rotatably arranged in the inner space to receive and dry laundry, wherein the laundry is tumbled while being dried, and an auxiliary crying unit arranged at a lower portion of the main body to receive and dry laundry, wherein the auxiliary drying unit dries the laundry using heated air discharged from the main drying unit.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments. The features of any one embodiment may be combined with the features of any other embodiment.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An apparatus for drying clothes, comprising:

a body including an inner space;

a first dryer rotatably arranged in the inner space to dry a first load of laundry, the first load of laundry being tumbled while being dried in the first dryer;

a main heater to heat external air flowing into the first dryer;

a second dryer to dry a second load of laundry without tumbling;

a heated air discharge path coupled to the first dryer, through which heated air discharged from the first dryer flows;

an inlet, through which the heated air is introduced from the heated air discharge path into the second dryer;

an outlet, through which the heated air used for drying the second load of laundry is discharged to the heated air discharge path; and a first auxiliary heater provided in the heated air discharge path to reheat the heated air flowing into the inlet, wherein the inlet protrudes upwardly from a top surface of the second dryer, and the outlet protrudes upwardly from a top surface of the second dryer; wherein the heated air discharge path has a first docking hole to allow for connection with the inlet and a second docking hole to allow for connection with the outlet; and wherein the apparatus for drying clothes further comprising:

a first shielding plate provided adjacent to the first docking hole; and a second shielding plate provided adjacent to the second docking hole, wherein the first shielding plate closes the first docking hole when the inlet does not dock with the heated air discharge path, and the first shielding plate closes the heated air discharge path between the first and second docking holes when the inlet docks with the heated air discharge path, wherein the second shielding plate closes the second docking hole when the outlet does not dock with the heated air discharge path, the second shielding plate closes the heated air discharge path between the first and second docking holes when the outlet docks with the heated air discharge path, and wherein the inlet and outlet face in substantially opposite directions.

2. The apparatus of claim 1, wherein the second dryer is located between the first dryer and a floor.

3. The apparatus of claim 1, further comprising:

a heated air introduction path that couples a rear portion of the first dryer to the main heater, wherein the heated air generated by the main heater is introduced into the first dryer through the heated air introduction path.

4. The apparatus of claim 1, further comprising:

a blower to provide a force to introduce the heated air from the main heater into the first dryer and to discharge the heated air from the first dryer to an outside of the body.

5. The apparatus of claim 1, further comprising:

a second auxiliary heater provided in the inlet to reheat the heated air introduced through the inlet.

6. The apparatus of claim 1, further comprising:

a blower to introduce the heated air from the heated air discharge path to the inlet, wherein the first auxiliary heater is disposed between the blower and the first docking hole.

7. The apparatus of claim 1, further comprising:

a blower to discharge the heated air from a body of the second dryer to the outlet.

8. The apparatus of claim 1, wherein:

the second dryer includes a slidable drawer, and the drawer includes a section in which the second load of laundry is suspended in a heated air circulation path.

9. The apparatus of claim 8, wherein the heated air circulation path passes over a top of and underneath clothes in the second load of laundry.

10. The apparatus of claim 1, wherein the heated air passes through the second dryer along a substantially U-shaped path.

11. The apparatus of claim 1, wherein the heated air discharged from the first and second dryers is output through a same outlet.

* * * * *